US005599209A

United States Patent [19]

Belopolsky

[11] Patent Number: 5,599,209

[45] Date of Patent: Feb. 4, 1997

[54] METHOD OF REDUCING ELECTRICAL CROSSTALK AND COMMON MODE ELECTROMAGNETIC INTERFERENCE AND MODULAR JACK FOR USE THEREIN

[75] Inventor: Yakov Belopolsky, Harrisburg, Pa.

[73] Assignee: Berg Technology, Inc., Reno, Nev.

[21] Appl. No.: 346,640

[22] Filed: Nov. 30, 1994

[51] Int. Cl.[6] ..... H01R 23/02

[52] U.S. Cl. ..... 439/676; 439/941

[58] Field of Search ..... 439/676, 188, 439/941, 607; 29/842, 857, 876–877, 881–884

[56] References Cited

U.S. PATENT DOCUMENTS

| | | | |
|---|---|---|---|
| 4,457,570 | 7/1984 | Bogese . | |
| 4,703,991 | 11/1987 | Philippson | 439/676 |
| 5,030,123 | 7/1991 | Silver | 439/188 |
| 5,123,854 | 6/1992 | Peterson et al. | 439/188 |
| 5,299,956 | 4/1994 | Brownell et al. | 439/638 |
| 5,310,363 | 5/1994 | Brownell et al. | 439/676 |
| 5,312,273 | 5/1994 | Andre et al. | 439/676 |
| 5,346,405 | 9/1994 | Mosser, III et al. | 439/188 |
| 5,364,294 | 11/1994 | Hatch et al. | 439/676 |
| 5,456,619 | 10/1995 | Belopolsky et al. | 439/676 |
| 5,470,244 | 11/1995 | Lim et al. | 439/941 |

FOREIGN PATENT DOCUMENTS

| | | | |
|---|---|---|---|
| WO95/19056 | 7/1995 | WIPO | H01R 19/00 |

OTHER PUBLICATIONS

Bob Strich, "Developments in LAN Cabling & Connectors" *Interconnection Technology*, Dec. 1993.

*Primary Examiner*—Samuel M. Heinrich
*Assistant Examiner*—Jill DeMello
*Attorney, Agent, or Firm*—Daniel J. Long; M. Richard Page

[57] ABSTRACT

Disclosed is a modular jack having a first plurality of wires which extend in a common vertical plane from the bottom wall of the housing across the opened end and to the top wall and then extend horizontally forward and then angularly downwardly and rearwardly back toward the rear opened end. A second plurality of wires extends first in a common vertical plane from the bottom wall across only a part of the rear opened end and then extends obliquely, horizontally and upwardly toward the front opened end. A method of use is also disclosed.

20 Claims, 4 Drawing Sheets

METHOD OF REDUCING ELECTRICAL CROSSTALK AND COMMON MODE ELECTROMAGNETIC INTERFERENCE AND MODULAR JACK FOR USE THEREIN

BACKGROUND OF INVENTION

1. Field of the Invention

The present invention relates to electrical connectors and more particularly to modular jacks for use in telecommunications equipment.

2. Brief Description of the Prior Developments

Modular jacks are used in two broad categories of signal transmission: analog (voice) and digital (data) transmission. These categories can overlap somewhat since digital systems are used for voice transmission as well. Nevertheless, there is a significant difference in the amount of data transmitted by a system per second. A low speed system would ordinarily transmit from about 10 to 16 megabites per second (Mbps), while a high speed system should be able to handle 155 Mbps or even higher data transfer speeds. Often, high speed installations are based on asynchronous transfer mode transmission and utilize shielded and unshielded twisted pair cables.

With recent increases in the speed of data transmission, requirements have become important for electrical connectors, in particular, with regard to the reduction or elimination of crosstalk. Crosstalk is a phenomena in which a part of the electromagnetic energy transmitted through one of multiple conductors in a connector causes electrical currents in the other conductors.

Another problem is common mode electromagnetic interference or noise. Such common mode interference is often most severe in conductors of the same length, when a parasitic signal induced by ESD, lightning or simultaneous switching of semiconductor gates arrives in an adjacent electrical node through multiple conductors at the same time.

Another factor which must be considered is that the telecommunications industry has reached a high degree of standardization in modular jack design. Outlines and contact areas are essentially fixed and have to be interchangeable with other designs. It is, therefore, important that any novel modular jack allow with only minor modification, the use of conventional parts or tooling in its production.

There is, therefore, a need for a modular jack which will reduce or eliminate crosstalk in telecommunications equipment.

There is also a need for a modular jack which will reduce or eliminate common mode electromagnetic interference in telecommunications equipment.

There is also a need for such a modular jack which can reduce or eliminate crosstalk and common mode interference which is interchangeable with prior art modular jacks and which may be manufactured using conventional parts and tooling.

SUMMARY OF THE INVENTION

In the method of the present invention crosstalk and common mode electromagnetic interference is reduced or eliminated by means of the following factors:

(a) the conductors are separated into two groups and each of these groups is positioned in a distinct separate area in the modular jack; (b) the distance between adjacent conductors is increased; (c) the common length between adjacent conductors is reduced; and (d) adjacent conductors of significantly different lengths are used. The modular jack which may be used to practice the method of this invention has an outer insulated housing having top and bottom walls and opposed lateral walls and front and rear open ends. A first plurality of wires extend in a common vertical plane from the bottom wall of the housing across the open rear end to the top wall and then extend horizontally forward and then angularly downwardly and rearwardly back toward the rear open end. A second plurality of wires extends first in a common vertical plane from the bottom wall across only a part of the rear open end and then extends obliquely, horizontally and upwardly toward the open front end. The downwardly extending oblique plane of the first plurality of wires and upwardly extending oblique plane of the second plurality of wires have a common length but that common length is small preferably being between 0.8 inch to 1.0 inch while the length of the horizontal section of the first group of wires is relatively much longer being preferably 0.6 inch to 2.0 inch.

BRIEF DESCRIPTION OF THE DRAWINGS

The present invention is further described with reference to the accompanying drawings in which.

DETAILED DESCRIPTION OF THE PREFERRED EMBODIMENT

Figure 1:
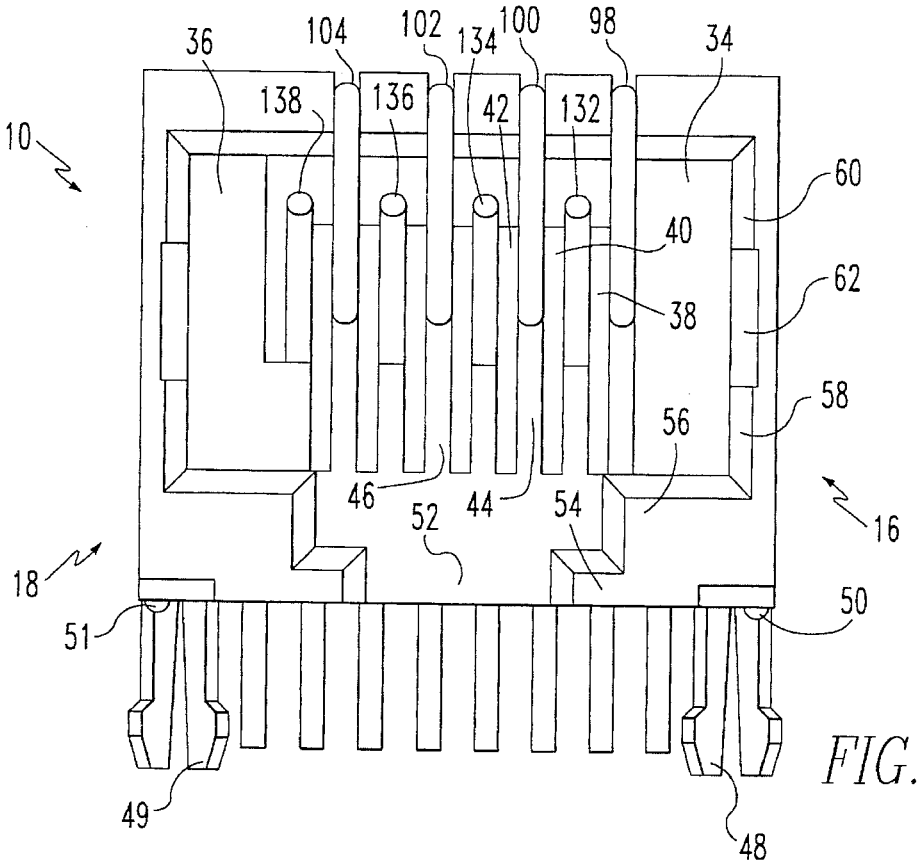
FIG. 1 is a front end view of the preferred embodiment of the modular jack assembly of the present invention.
Figure 2:
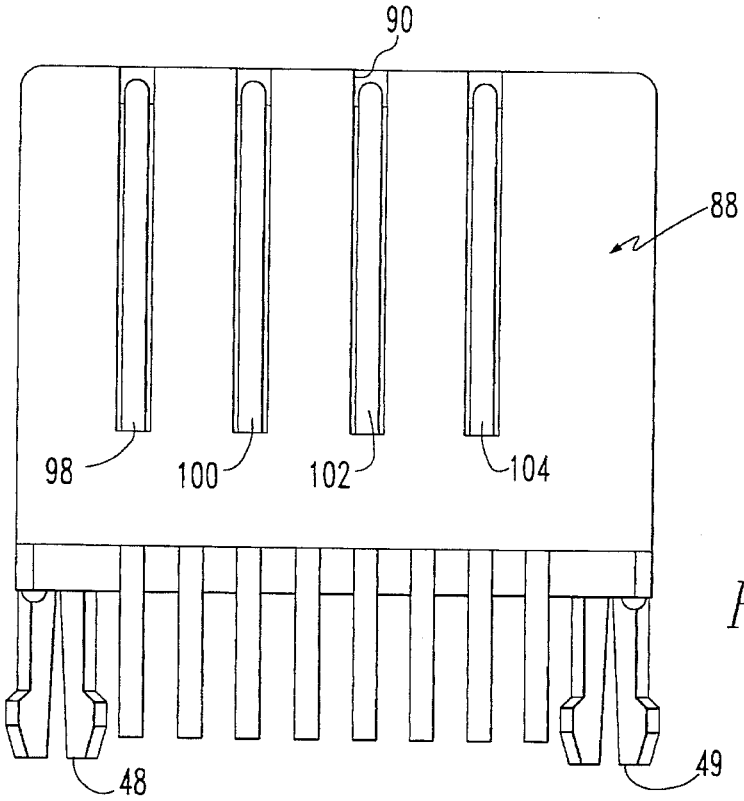
FIG. 2 is a rear end view of the modular jack assembly shown in FIG. 1.

Referring to the drawings, the outer insulative housing is shown generally at numeral 10. This housing includes a top wall 12, a bottom wall 14 and a pair of opposed lateral walls 16 and 18. The material from which the housing is constructed is a thermoplastic polymer having suitable insulative properties. Within these walls is an interior section 20 which has a rear open end 22 and a forward open end 24. Projecting upwardly from the bottom wall in this interior section there is a medial wall generally shown at numeral 26 which has a rear side 28, a front side and an inclined top side 32 which slopes upwardly and forwardly from its rear side toward its front side. Adjacent to the lateral walls, the medial lateral extensions 34 and 36 which serve as projections to retain other elements as will be hereafter explained. Interposed between these lateral extensions there are a plurality of wire separation extensions as at 38, 40 and 42 and between these wire separation extensions there are plurality of slots at 44 and 46.

Figure 3:
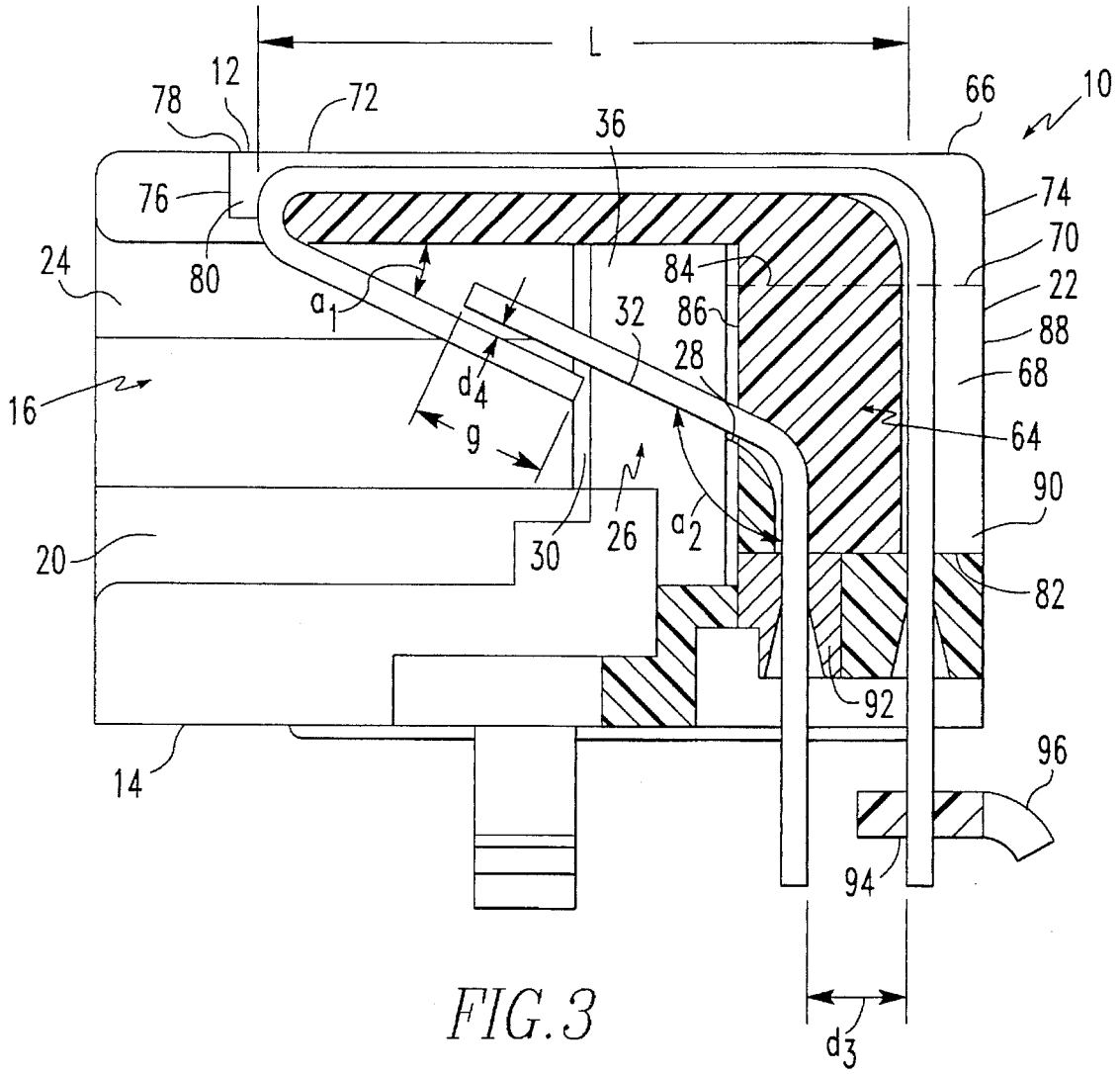
FIG. 3 is a cross sectional view taken through line III—III in FIG. 5.
Figure 4:
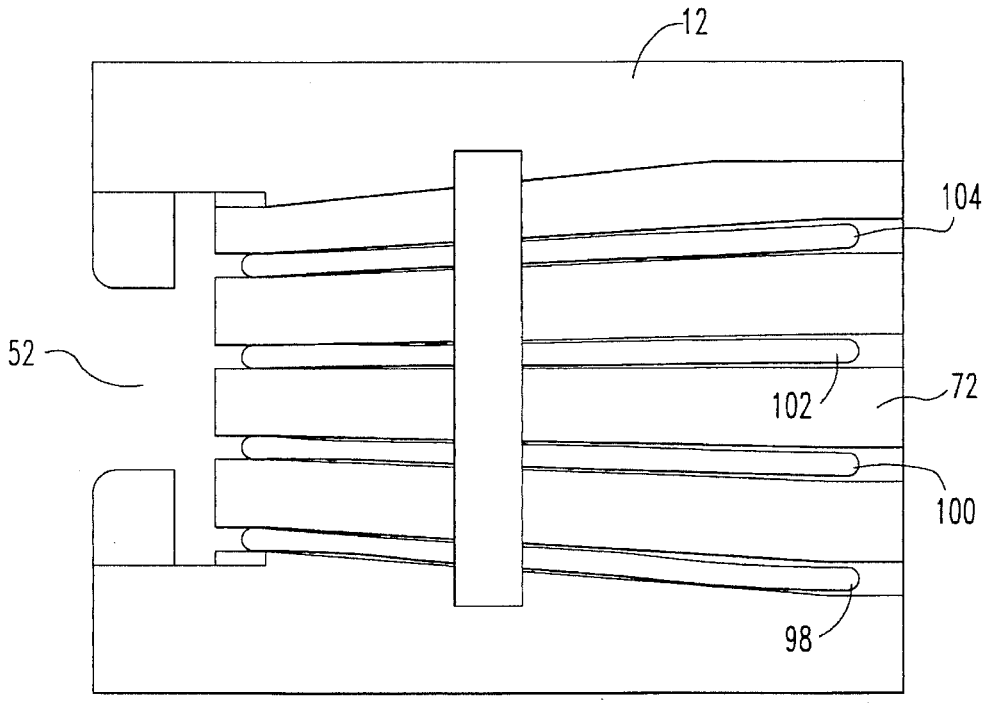
FIG. 4 is a top plan view of the modular jack assembly shown in FIG. 1.
Figure 6:
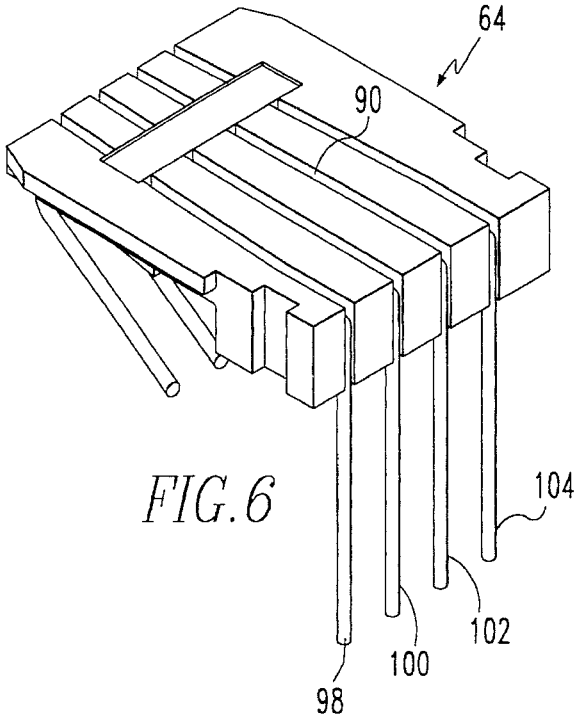
FIG. 6 is a perspective view of part of the insulated insert element of the modular jack assembly shown in FIG. 1.
Figure 7:
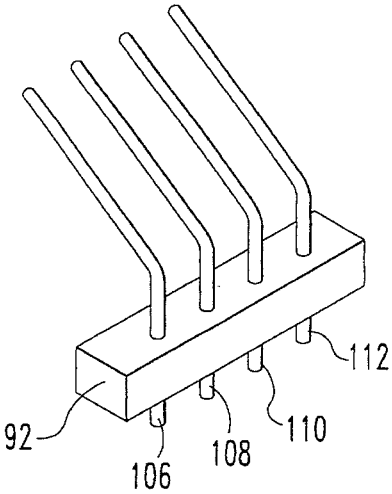
FIG. 7 is a perspective view of the wire retaining element of the modular jack assembly shown in FIG. 1.

Extending downwardly from the bottom wall there are a pair of pins 48 and 49 and a pair of stand offs 50 and 51. In the bottom wall of the insulative housing there is also a front slot 52. The lateral wall 16 includes a lower shoulder 54, another shoulder 56, a lower main wall 58, an upper main wall 60 and a recessed wall 62 interposed between the lower and upper main wall. It will be seen that the lateral wall 18 has substantially identical features as lateral wall 16. Referring particularly to FIGS. 3 and 6, the insulative insert shown generally at numeral 64 may be considered to be comprised of an upper section 66 and a lower section 68. Although in the embodiment illustrated in FIG. 3 these sections make up one integral insert, it will be understood that the insert may comprise two separate upper and lower sections or only an upper section may be used as is shown in FIG. 6. The upper section includes a base side 70, an upper side 72, a rear end 74 and a terminal end 76. On the upper side there are a plurality of upper side grooves as at 78 and at the terminal end there are terminal end grooves as at 80. The lower section includes a bottom end 82 a top end 84 a front side 86 and a rear side 88. On this rear side there are a plurality of vertical grooves as at 90 which adjoin the grooves on the upper side of the upper section. The insulated insert is superimposed over a conductive wire retaining element 92 which engages one group of wires as is explained hereafter. Another group of wires is engaged by a grounding strip 94 having a grounding tab 96 as is also explained hereafter.

In a first common plane there is a first group of wires 98, 100, 102 and 104. There is also a second group of wires in a common plane which is made up of wires 106, 108, 110 and 112. It will be seen that the first group of wires are in a common first plane shown generally at 114. In this first plane there is a vertical section 116 in which the wires extend upwardly from a point beneath the bottom wall of the insulated housing and from that bottom wall to the top wall of the insulated housing from where they extend horizontally toward the front end of the housing in horizontal section 118 of the plane and then extend rearwardly and downwardly toward the rear end of the housing in angular oblique section of the plane 120. It will be noted that there is an angle $a_1$ between the horizontal and oblique sections of the plane and that the horizontal section has a distance I. It will also be observed that the angular oblique section of the plane ends in terminal edge 122. The second group of wires is in a second plane shown generally at numeral 124. In this plane the wires extend first upwardly from below the bottom wall of the housing in a common vertical section of the plane 126. Before reaching the top wall of the housing and preferably at a point medially between the bottom and top wall, the wires in the second plane extend forwardly and upwardly into the interior of the housing in angular oblique section 128 of the second plane. This oblique section ends in a terminal edge 130. This common plane includes wires 106, 108, 110 and 112. It will be noted that there is an angle $a_2$ between the vertical section and the oblique section of the second plane. It will also be noted that there is a distance g which is the longitudinal distance between the terminal edges of the first plane and the second plane. It will also be noted that in both the first plane and the second plane there is uniform distance between adjacent wires in the first group and the second group of wires which is shown, for example, as $d_1$ in the first group of wires and $d_2$ in the second group of wires. The distance between the vertical sections of the first and second planes is shown as $d_3$. The distance between the oblique sections of the first and second planes is shown as $d_4$. Preferably the distance 1 is from 0.2 inch to 2.0 inch and the distance g is from 0.2 inch to 1.0 inch while the distances $d_1$ and $d_2$ are from 0.040 inch to 0.250 inch. $d_3$ is from 0.040 inch to 0.200 inch, and $d_4$ is from 0.0 inch to 0.3 inch. Angle $a_1$ will preferably be from 15° to 70°, and angle $a_2$ will preferably be 105° to 160°. The wires will preferably be from 0.01 inch to 0.05 inch in diameter. The overall lengths of the wires in the first plane will be from 1.0 inch to 3.0 inch, and the overall lengths of the wires in the second plane will be from 0.5 inch to 1.5 inch.

EXAMPLE

Figure 5:
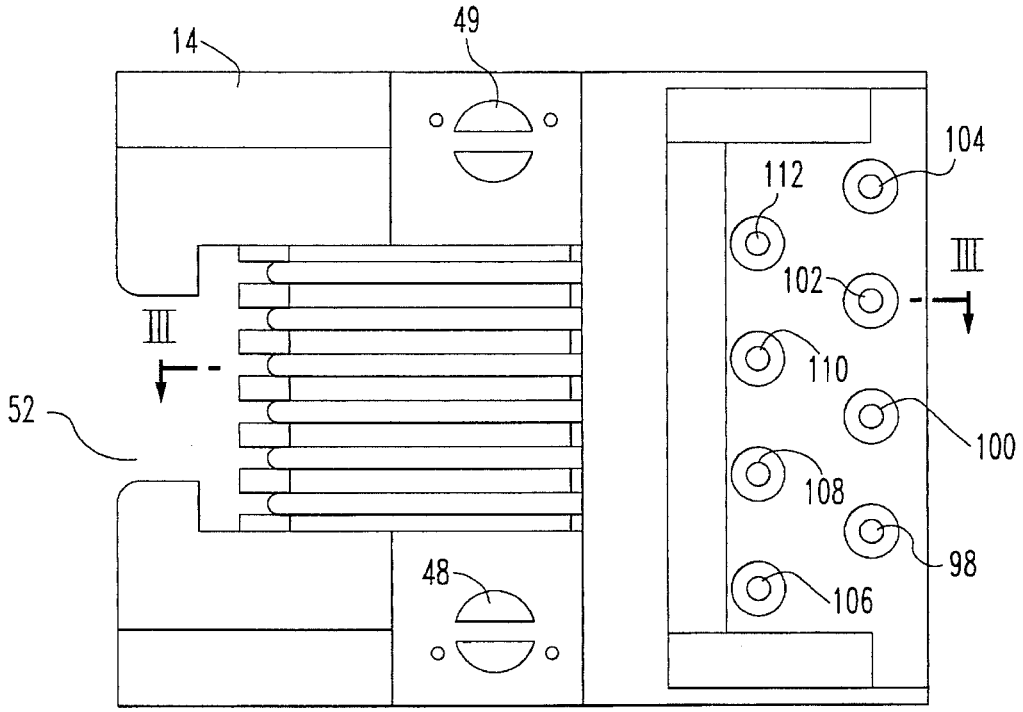
FIG. 5 is a bottom plan view of the modular jack assembly shown in FIG. 1.
Figure 8:
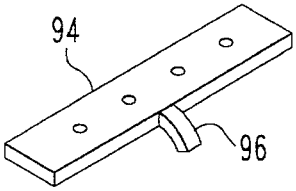
FIG. 8 is a perspective view of the grounding strip element of the modular jack assembly shown in FIG. 1.

Four modular jacks were manufactured according to the following description. The overall lengths of the wires in the first group was 1.75 inch. The overall lengths of the wires in the second group was 0.75 inch. Eight wires were arranged in substantially the same pattern as is shown in FIG. 5. For the purpose of this description the positions shown in FIG. 5 will be referred to as shown in the following Table I.

TABLE 1

WIRE 1—106
WIRE 2—98
WIRE 3—108
WIRE 4—100
WIRE 5—110
WIRE 6—102
WIRE 7—112
WIRE 8—104

Figure 9:
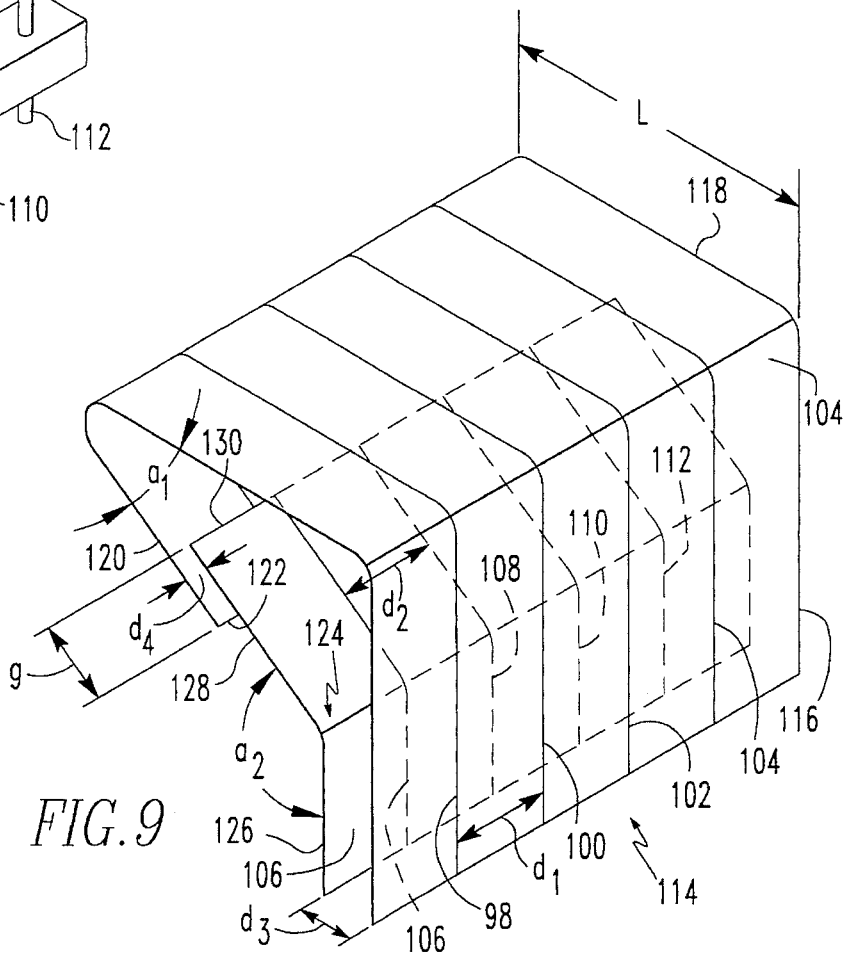
FIG. 9 is the schematic view of the modular jack assembly similar to FIG. 3 in which common planes of the groups are illustrated.

One jack (JACK 1) was manufactured in the conventional manner so that all the wires extended vertically from the bottom wall of the housing then horizontally forward then downwardly and rearwardly back toward the rear open end. In the other three jacks, made within the scope of this invention, two to four wires were positioned generally as described above in the second plane as at numeral 124 in FIG. 9. The other wires extended upwardly, horizontally then downwardly and rearwardly generally as in the first plane 114 in FIG. 9 or in a plane parallel to such a plane. The specific positioning of the wires is shown according to the following Table 2.

TABLE 2

| JACK | WIRES IN FIRST PLANE OR PARALLEL TO | WIRES IN SECOND PLANE |
|---|---|---|
| 1 | 1–8 | NONE |
| 2 | 1, 3, 5, 7 | 2, 4, 6, 8 |
| 3 | 1, 2, 4, 6, 7, 8 | 3, 5 |
| 4 | 1, 2, 4, 6, 8 | 3, 5, 7 |

In all the jacks the length 1 was 0.6 inch, and angle $a_1$ was 30°. In JACKS 2, 3 and 4 the length g was 0.4 inch and angle $a_2$ was 120°. The distances between wires in each row ($d_1$ and $d_2$) was 0.100 inch in all the jacks. The distance between the rows ($d_3$) was 0.100 inch in all the jacks. The transverse distance between the oblique planes of wires ($d_4$) in JACK 2, JACK 3 and JACK 4 was 0.020 inch. In all the jacks the wires were 0.020 inch in diameter and had an overall length of about 1.75 inch for wires positioned in the first plane and about 0.75 inch for wires positioned in the insulative housing. The insulative housing and insulative insert were a polyester resin. The following test was performed on these modular jacks.

Comparative Test

Transmission performance of connecting hardware for UTP cabling (without cross-connect jumpers or patch cords)

was determined by evaluating its impact upon measurements of attenuation, NEXT less and return loss for a pair of 100 Ω balanced 24 AWG (0.02 inch) test leads. After calibration, reference sweeps were performed the test leads and impedance matching terminations were connected to the test sample and connector transmission performance data was collected for each parameter. With the network analyzer calibrated to factor out the combined attenuation of the baluns and test leads; 100Ω resistors were connected across each of the two balanced outputs of the test baluns. In order to minimize inductive effects, the resistor leads were kept as shod as possible (0.2 inch or less per side). The cable pairs were positioned such that they are sequenced 1& 2, 3& 6, 4 & 5 and 7 & 8 respectively. To prevent physical invasion between pairs under the jacket when the plug was crimped, the side-by-side orientation of the test leads extended into the jacket a distance of at least 0.3 inch, creating a flat portion. The flat, jacketed portion of the test leads appeared to be oblong in cross-section. To measure a telecommunications outlet/connector, the plug was then mated with the test jack and NEXT loss measurements were performed. Results of this test were shown in the attached Table 3.

TABLE 3

| | CROSSTALK BETWEEN WIRES (dB) | | | | | |
|---|---|---|---|---|---|---|
| JACK | 1 & 2 | 1 & 3 | 1 & 4 | 2 & 3 | 2 & 4 | 3 & 4 |
| 1 | −32.9 | −43.0 | −47.0 | −42.0 | −41.7 | −52.0 |
| 2 | −40.5 | −41.7 | −41.2 | −50.4 | −44.6 | −52.3 |
| 3 | −40.8 | −41.7 | −50.8 | −52.0 | −42.5 | −80.4 |
| 4 | −40.6 | −48.4 | −46.6 | −44.6 | −54.0 | −80.6 |

From the foregoing Example and Comparative Test, it will be appreciated that it may be advantageous to construct a jack of the present invention so that at least one wire may extend vertically through the lower vertical section of the second plane and continue to extend vertically to the top wall and then extend horizontally adjacent the top wall and then downwardly and rearwardly toward the rear open end. Examples of such wires would be wires 1 and 7 in JACK 3 and wire 1 in JACK 4.

It will be appreciated that there has been described a method of reducing or eliminating crosstalk as well as common mode electromagnetic interference and a modular jack for use therein. It will also be appreciated that this modular jack is interchangeable with conventional modular jacks and can be manufactured easily and inexpensively with conventional pads and tooling.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack assembly for receiving for another connecting element having contacts for signal transmission comprising:

(a) an outer insulative housing having top and bottom walls and opposed lateral walls all defining an interior section and said housing also having front and rear open ends;

(b) a first plurality of generally parallel conductive means extending from adjacent the bottom wall of the insulative housing across the rear end to the top wall in a common plane and then toward the front end in a common plane then toward the rear end in a common oblique plane having a first terminal edge;

(c) a second plurality of generally parallel conductive means extending from adjacent the bottom wall of the insulative housing across only a part of the rear end in a common plane and then angularly toward the front end in a common oblique plane having a second terminal edge which extends beyond the first terminal edge of the oblique plane of the first plurality of conductive means such that said oblique planes of the first and second plurality of conductive means are positioned in overlapping relation and the portions of both of said first and second pluralities of conductive means that are located in said oblique planes are positioned for engaging the contacts of said other connecting element when said other connecting element is inserted into the front open end of the housing for signal transmission; and (d) an insulative insert in which said first plurality of conductive means are at least partially positioned said insulative insert has an upper section having a base and upper sides and rear and terminal ends and is positioned so that its base side is superimposed over the rear open end of the insulative housing and its upper end is adjacent the top side of the insulative housing such that its terminal end extends into the interior section of the insulative housing.

2. The modular jack assembly of claim 1 wherein the insulative insert has a lower section having a bottom end and which extends upwardly therefrom to cover at least part of the rear open end.

3. The modular jack assembly of claim 1 wherein each of the first plurality of conductive means are separated from adjacent conductive means by a distance of from about 0.040 inch to about 0.025 inch.

4. The modular jack assembly of claim 1 wherein each of the second plurality of conductive means are separated from adjacent conductive means by a distance of from about 0.040 inch to about 0.025 inch.

5. The modular jack assembly of claim 1 wherein the first plurality of conducting means are secured in a conductive means securing element which is positioned beneath the bottom and of the vertical lower section of the insulative insert.

6. The modular jack of claim 1 wherein the first plurality of conductive means are wires having an overall length of from about 1.0 inch to about 3.0 inch and which have diameters of from about 0.06 inch to about 0.20 inch.

7. The modular jack of claim 1 wherein the second plurality of conductive means are wires having an overall length of from about 0.5 inch to about 1.5 inch and which have diameters of from about 0.06 inch to about 0.20 inch.

8. The modular jack assembly of claim 1 wherein the upper section of the first plane has a length and the length of the upper section is from about 0.2 inch to about 2.0 inch.

9. The modular jack assembly of claim 8 wherein the angle between the upper section of the first plane and the oblique section of the first plane is from about 15° to 70°.

10. The modular jack assembly of claim 8 wherein there is an angle between the vertical section and the oblique section of the second plane and said angle is from about 15° to about 160°.

11. The modular jack of claim 8 wherein there is at least one conductive means which extends vertically through the lower vertical section of the second plane and continues to extend vertically to the top wall and then extends horizontally adjacent the top wall and then downwardly and rearwardly toward the rear open end.

12. The modular jack assembly of claim 1 wherein the oblique section of the first plane and the oblique section of the second plane are parallel.

13. The modular jack assembly of claim 12 wherein the oblique section of the second plane has a second terminal end and there is a longitudinal distance between the first terminal edge and the second terminal edge and said longitudinal distance is from about 0.2 inch to about 1.0 inch.

14. The modular jack assembly of claim 13 wherein the oblique section of the first plane and the oblique section of the second plane are separated by a transverse distance of from about 0 to 0.3 inch.

15. The modular jack assembly of claim 14 wherein the vertical section of the first plane and the vertical section of the second plane are parallel.

16. The modular jack assembly of claim 15 wherein the vertical section of the first plane and the vertical section of the second plane are separated by a distance of from about 0.04 inch to about 0.250 inch.

17. The modular jack assembly of claim 1 wherein the second plurality of conducting means are secured in the conductive means securing element.

18. The modular jack assembly of claim 17 wherein there are a plurality of horizontal grooves on the upper surface of the upper section of the insulative insert and one of said plurality of first conducting means is positioned in each of said upper grooves.

19. The modular jack assembly of claim 18 wherein there are a plurality of vertical grooves on the rear surface of the lower section of the insulative insert and each of said vertical grooves adjoins one of the horizontal grooves on the upper surface of the upper section and one of said plurality of said first conducting means is positioned in each of said upper grooves.

20. The modular jack assembly of claim 19 wherein there are a plurality of vertical grooves on the front surface of the lower section of the insulative insert and one of said second plurality of conductive means is positioned in each of said grooves.

* * * * *

Adverse Decision In Interference

Patent No. 5,599,209, Yakov Belopolsky, METHOD OF REDUCING ELECTRICAL CROSSTALK AND COMMON MODE ELECTROMAGNETIC INTERFERENCE AND MODULAR JACK FOR USE THEREIN, Interference No. 104,590, final judgment adverse to the patentee rendered September 19, 2002, as to claims 1-11 and 17-20.

*(Official Gazette November 26, 2002)*